US006073414A

United States Patent [19]

Garris et al.

[11] Patent Number: 6,073,414

[45] Date of Patent: Jun. 13, 2000

[54] LIGHT GAUGE METAL TRUSS SYSTEM

[75] Inventors: Ronald R. Garris, Dearborn, Mich.; H. Norris Havens, Vero Beach, Fla.; C. F. Miranda, Cary, N.C.

[73] Assignee: Dale Industries, Inc., Dearborn, Mich.

[21] Appl. No.: 08/874,101

[22] Filed: Jun. 12, 1997

[51] Int. Cl.[7] ..... E04C 2/38

[52] U.S. Cl. ..... 52/694; 52/696; 52/729.5; 52/731.7

[58] Field of Search ..... 52/92.2, 93.1, 52/93.2, 262, 713, 715, 92.1, 92.3, 634, 636, 693, 694, 695, 696, 720.1, 729.5, 729.2, 731.1, 731.7, 737.6; 428/593, 603

[56] References Cited

U.S. PATENT DOCUMENTS

| | | | |
|---|---|---|---|
| 2,818,947 | 1/1958 | Goldberg | 52/715 |
| 3,224,154 | 12/1965 | Toti et al. | 52/93.2 X |
| 3,423,898 | 1/1969 | Tracy et al. | 52/713 |
| 4,018,020 | 4/1977 | Sauer et al. | 52/715 X |
| 4,335,555 | 6/1982 | Southerland et al. | 52/713 X |
| 5,224,322 | 7/1993 | Van Den Toorn | 52/715 X |
| 5,459,967 | 10/1995 | Bodtker | 52/93.1 |
| 5,463,837 | 11/1995 | Dry | 52/92.2 X |
| 5,577,353 | 11/1996 | Simpson | 52/92.2 |
| 5,771,653 | 6/1998 | Dolati et al. | 52/737.6 |
| 5,927,041 | 7/1999 | Sedlmeier et al. | 52/731.7 X |

*Primary Examiner*—Richard Chilcot
*Attorney, Agent, or Firm*—Rogers & Killeen

[57] ABSTRACT

A light gauge metal truss system including trusses contructed of roll formed truss chord and truss web members and a two piece roll formed truss anchor for anchoring the truss to a wall. The truss chord members are roll formed to have a generally U-shaped cross-section with a base and two substantially parallel legs with reinforcement ribs and inwardly turned hems to improve structural capacity thus improving the strength-to-weight ratio of the chord member and minimizing costs. The truss web members are roll formed to have an H-shaped cross-section with the internal flange offset from the center of the legs to provide an enlarged attachment surface. The web member also includes reverse folds and hems to improve structural capacity thus improving the strength-to-weight ratio of the web members and minimizing costs.

48 Claims, 9 Drawing Sheets

PEAK CONNECTION MEMBER

LIGHT GAUGE METAL TRUSS SYSTEM

BACKGROUND OF THE INVENTION

The present invention relates to a truss system including a truss, truss members for use in the construction of trusses, and to a truss anchor for use in anchoring a truss to a wall. More particularly, the truss system includes trusses constructed of roll-formed light gauge metal truss members which may be anchored to a wall with two-piece roll-formed light gauge metal truss anchors located at spaced intervals along the length of the wall.

In the construction field, because of the rising cost and declining quality of wood, structural members and fixtures are increasingly comprised of light gauge metal. To produce the most economical truss and truss anchoring system, light gauge metal is roll formed into elongated truss members with a cross-section designed to achieve maximum strength of the member to meet the required structural codes while minimizing the weight of the metal used. Typically such truss members have been formed with a C-shaped cross-section but suffer from a low strength-to-weight ratio. More recently, truss members have been formed with a U-shaped cross-section having reinforcement ribs in the base and the legs and stiffening flanges projecting outward at the ends of the legs to improve the strength-to-weight ratio of the members. These prior art truss members, however, are not easily assembled into trusses as they do not have a planar outer surface and have unhemmed edges which present a safety hazard. Further, the trusses formed from these prior art truss members are not easily transported and are not easily lifted for erection at the job site, adding unnecessary costs to building construction.

Accordingly, it is an object of the present invention to provide a novel truss system in which the structural members and fixtures are formed from light gauge metal.

It is another object of the present invention to provide a novel truss chord member which is easily roll formed having a cross-section that optimizes the strength of the member for the weight of the metal used and provides ease of production, transportation, and lifting for erection at the job site.

It is another object of the invention to provide a truss system with truss chord members having a planar outer surface conducive to assembly into trusses.

It is yet another object of the present invention to provide a novel truss web member that is easily roll formed having a cross-section that optimizes the strength of the member for the weight of the metal used and provides ease of production, transportation, and lifting for erection at the job site.

It is still another object of the present invention to provide novel truss members with cross-sections that maximize the amount of flat surfaces for easy attachment of the members at the job site.

It is a further object of the present invention to provide novel truss members with hemmed edges for stiffening of the members and safety.

In a typical building construction, the assembled trusses for establishing the framework for the flooring or the roofing are transversely positioned atop a wall and anchored thereto. It is known in such construction to use one-piece anchors attached to the top track member of the wall at spaced intervals along the length thereof for positioning and anchoring the trusses to the wall. Such anchors are typically produced from stamped metal which is costly and generates waste metal. Such anchors are also susceptible to up-lifting forces such as wind and do not allow for minor adjustments when positioning the truss atop the wall.

Accordingly, it is a further object of the invention to provide a truss system with two-piece truss anchors produced from roll formed metal.

It is another object of the invention to provide a truss system that can withstand wind up-lifting forces.

It is a further object of the invention to provide a truss system which allows minor adjustments in the positioning of the truss atop the wall for anchoring thereto.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
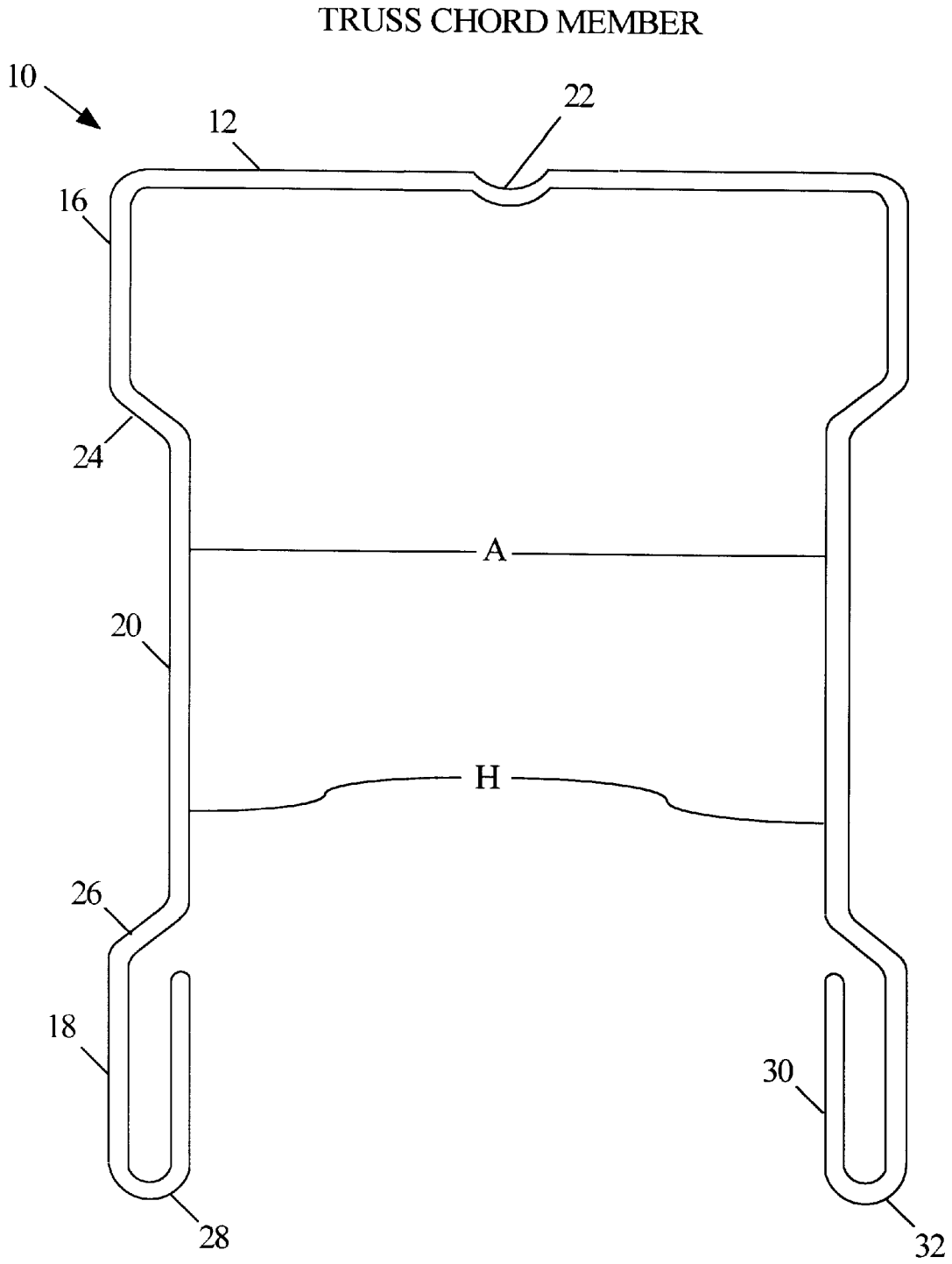
FIG. 1 illustrates the cross-section of the truss chord member.

One embodiment of the cross-section of the truss chord member of the present invention is shown in FIG. 1. With reference to FIG. 1, the truss chord member 10 is an elongated structural chord member comprising in cross-section a base 12, and two substantially parallel legs 14 extending in the same direction from the longitudinal edges of the base 12 at a substantially right angle. The legs 14 include a first outer face 16 adjacent the base 12, a second outer face 18 adjacent the distal end of the leg 14, an inwardly recessed face 20 connecting the first outer face 16 and the second outer face 18, and an inwardly turned hem 28 extending from the second outer face 18.

In the preferred embodiment, the base 12 is flat to facilitate attachment to roofing or flooring materials and includes a longitudinal recessed groove 22 in the middle for added structural capacity. The first outer face 16 is adjacent the base 12 giving the base sufficient width to prevent rubbing (i.e., squeaking) of truss web members abutting the base 12 and between the legs 14. The extra width of the base 12 also provides a larger area for roofing or flooring material attachment. The first outer face 16 and the second outer face 18 are coplanar forming a planar outer surface which allows single plane construction of trusses and provides for ease of stacking, transportation, and lifting for erection at the job site.

In the preferred embodiment, the inwardly recessed face 20 is recessed inward from the outer faces 16, 18 a distance equal to two thicknesses of the chord member material. The recessed faces 20 of each leg provide flat surfaces for attachment to structural members inserted therein. The structural members may be attached by any conventional means such as screws, self-piercing rivets, welding, or press joining.

An inwardly angled portion 24 and an outwardly angled portion 26 interconnect the recessed face 20 to the first and second outer faces 16, 18 respectively. The first outer face 16 and the inwardly angled portion 24 comprise a reinforcement rib as does the second outer face 18 and the outwardly angled portion 26 which add structural capacity to the chord member. The inwardly turned hem 28 includes an inner face 30 and an interconnecting portion 32. The inner face 30 is coplanar with the inwardly recessed face 20 to provide a planar inner surface which is conducive to receiving a structural member between the legs 14. The hem 28 provides structural capacity to the chord member to prevent local buckling when the member is under load. The interconnecting portion 32 is normal to the second outer face 18 and the inner face 30 and provides a gap in hem 28 for added structural capacity over a hem which is simply a reverse fold. The inwardly turned hem 28 on each leg also provides additional safety by recessing the sharp edges of the metal member.

Figure 2:
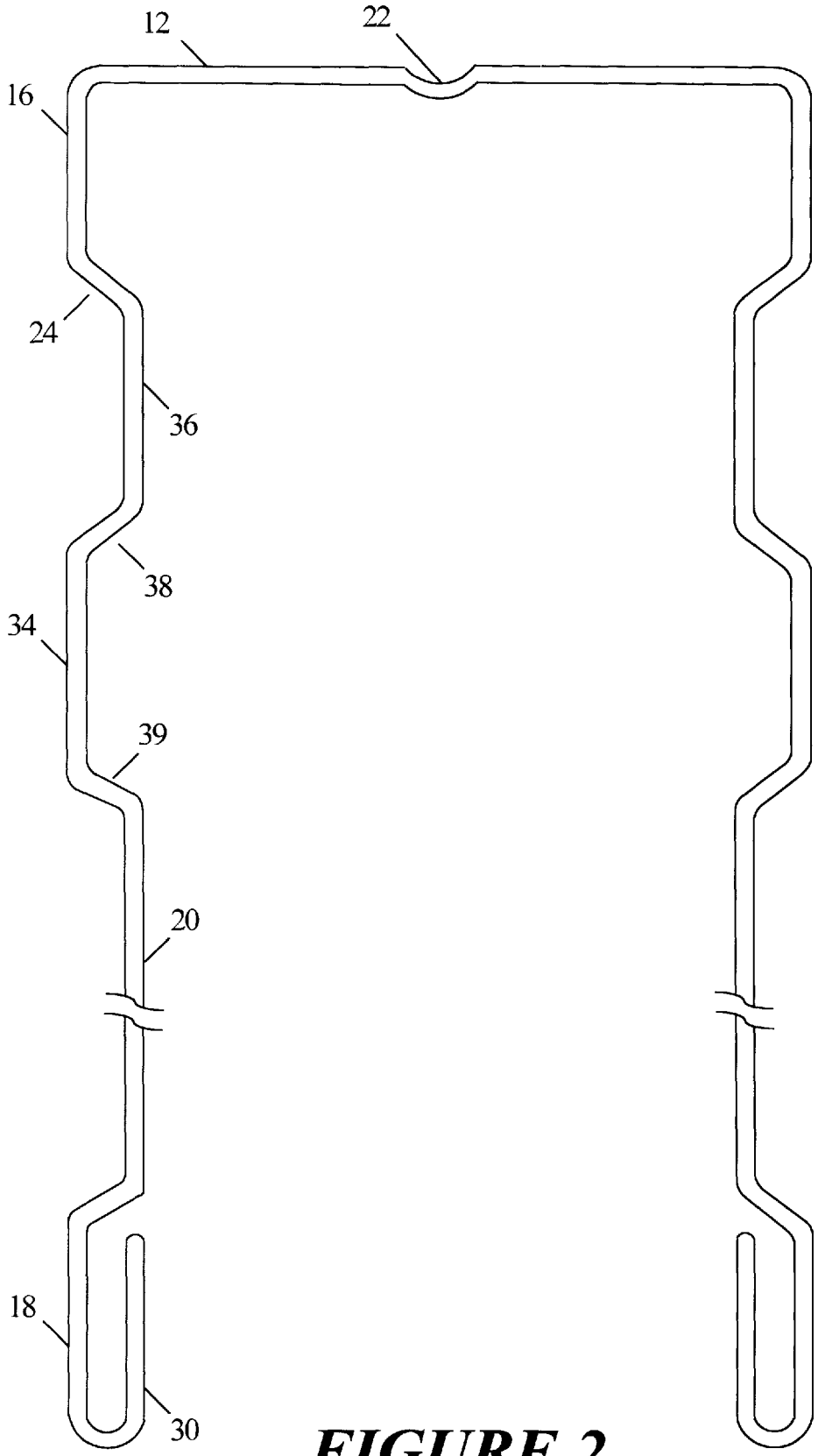
FIG. 2 illustrates another cross-section of the truss chord member.

FIG. 2 shows another embodiment of the cross-section of the truss chord member. The leg 14 may further comprise a third outer face 34 and a second inwardly recessed face 36 interconnecting the first outer face 16 and the inwardly recessed face 20 and providing the leg 14 with added structural capacity. The third outer face 34 is coplanar with the first and second outer faces 16, 18 providing the planar outer surface. The second inwardly recessed face 36 is coplanar with the inwardly recessed face 20 and the inner face 30 providing the planar inner surface.

The third outer face 34 is interconnected to inwardly recessed faces 36, 20 by angled portions 38 and 39 respectively. Outer face 34 and the angled portions 38, 39 comprise a third reinforcement rib adds structural capacity to the chord member.

The dimensions of the truss chord member 10 may vary according to specific design requirements. In one embodiment, the base 12 has a width of 2" and has a longitudinal recessed groove 22 which is ⅛" deep and ¼" wide. The width of the groove 22 may vary with the width of the base 12. The first and second outer faces 16,18 have a length of ½" and inwardly recessed face 20 has a length of 1 ¼" . The length of the legs 14 is typically 2 ½" or 3 ½" in this embodiment. For leg lengths longer than 3 ½", it is desirable to include the third reinforcement rib comprising outer face 34 and angled portions 38,39.

The chord members may be made from any suitable material such as 22 gauge, 20 gauge, 18 gauge, 16 gauge, or 14 gauge galvanized steel providing members with a yield strength ranging from 33,000 psi to 80,000 psi. This design is very cost effective by providing a truss chord member which meets the strength requirements of the latest structural design codes with a high strength-to-weight ratio thus saving material costs.

Figure 3:
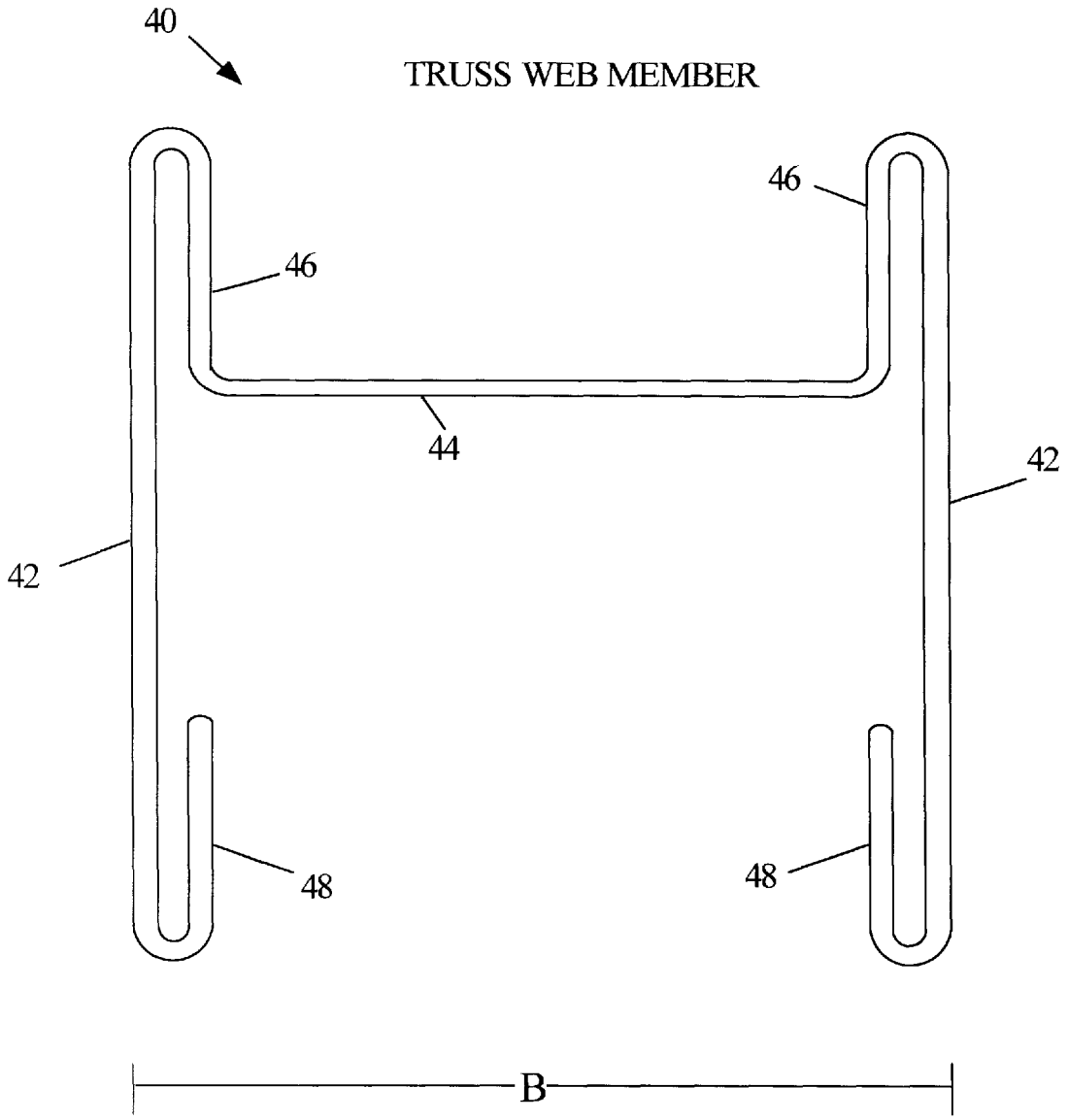
FIG. 3 illustrates the cross-section of the truss web member.

One embodiment of the cross-section of the truss web member of the present invention is shown in FIG. 3. With reference to FIG. 3, the truss web member 40 is an elongated structural web member comprising in cross-section two substantially parallel sides 42 and a central web 44 substantially perpendicular to the sides 42 forming an "H", shape. Each of the sides 42 is connected at one end to the web 44 by an inward reverse fold 46. Reverse fold 46 overlies less than one-half of the length of the side 42 so that web 44 interconnects the sides 42 at a point which is off the center of the length of the sides forming a modified "H" shape. The portion of the sides which extends beyond the reverse fold provides the web member with a larger flat surface than a standard "H" shaped member (with the web interconnecting the sides at the center of the length of the sides) to facilitate connection to other structural members.

Each of the sides 42 has a second reverse fold overlying less than one-half the length of the side at its distal end forming a stiffening hem 48. Reverse folds 46 and hems 48 add structural capacity to the member giving the member a higher strength-to-weight ratio than a standard "C" shaped member while providing a larger attachment surface than a standard "H" shaped member and allowing attachment to other members by means requiring access to both sides of the attachment surface such as clinching.

The dimensions of the truss web member 40 may vary according to design requirements. In the preferred Embodiment, the outside dimension B of the web member 40 is the sane as the inside dimension A (as shown in FIG. 1) of the chord member.

The web members may be made from any suitable material such as 22 gauge, 20 gauge, 18 gauge, 16 gauge, or 14 gauge galvanized steel providing members with a yield strength ranging from 33,000 psi to 80,000 psi. The combination of stiffening hems and component dimensions provides a web member which meets the strength requirements unique to truss web members with a high strength-to-weight ratio thus saving material costs.

Figure 4:
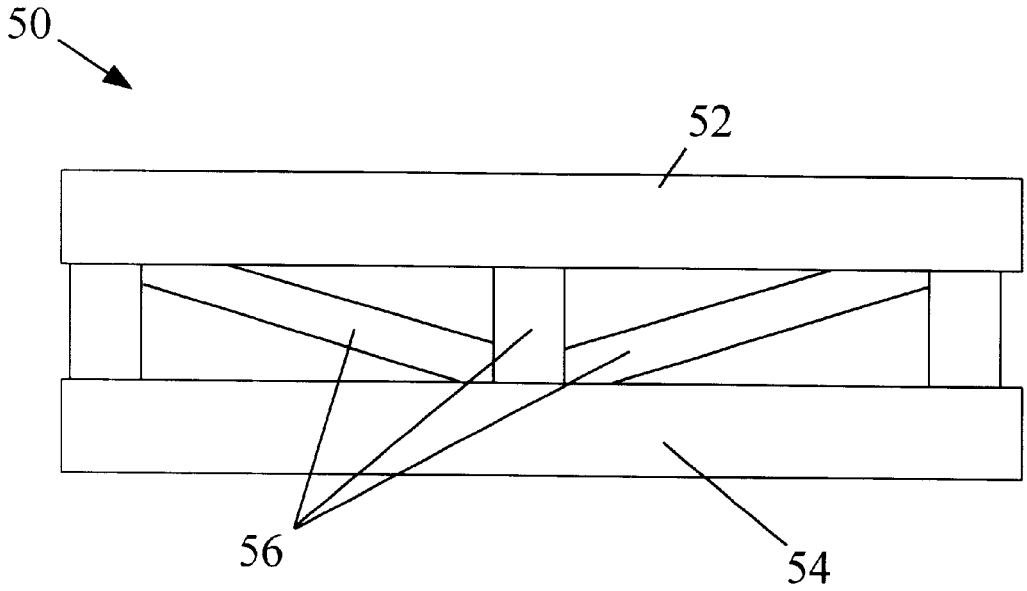
FIG. 4 illustrates a truss assembled from the truss members of the invention.
Figure 5:
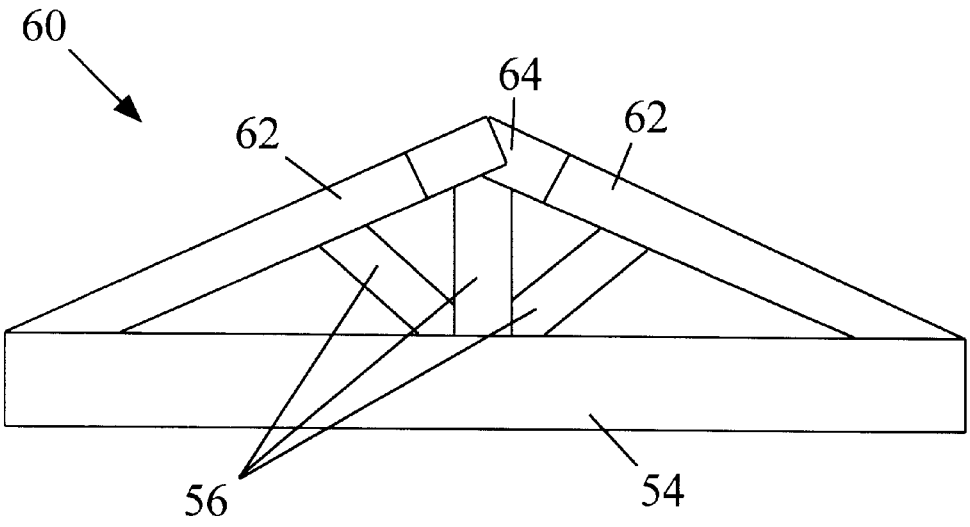
FIG. 5 illustrates a roof truss assembled from the truss members of the invention.

FIGS. 4 and 5 show embodiments of trusses formed with the truss chord members of FIGS. 1 or 2, and the truss web member of FIG. 3. These truss members may be used in the construction of trusses generally, such as roof, floor, girder, jack, or stub trusses. FIGS. 4 and 5 illustrate only an example of a specific geometry of trusses constructed from these truss members.

With reference to FIG. 4, a parallel chord truss 50 may be formed with an upper chord member 52, a lower chord member 54, and a plurality of interconnecting truss web members 56. In the preferred embodiment, upper chord member 52 has the cross-section of the chord member of FIG. 1 or 2 and is positioned with legs 14 extending downward to receive the upper end of the interconnecting web members 56 inserted therebetween for attachment thereto. Lower chord member 54 has the cross-section of the chord member of FIG. 1 or 2 and is positioned with legs 14 facing upward to receive the lower end of the interconnecting web members 56 inserted therebetween for attachment thereto. The truss 50 may be formed from chord members wherein the upper chord member 52 has the cross-section of the chord member of FIG. 1 or 2, or the lower chord member 54 has the cross -section of the chord member of FIG. 1 or 2, or both the upper and lower chord members 52,54 have the cross-section 2 of the chord member of FIG. 1 or 2. The web members 56 have the cross-section of FIG. 3 and are positioned so that the outer faces of the sides 42 are adjacent the inner faces of recessed faces 20 of legs 14 when inserted therebetween. Sides 42 may be attached to recessed faces 20 by any conventional means such as screws, self-piercing rivets, welding, or press joining.

With reference to FIG. 5, a roof truss 60 may be formed with two upper chord members 62 coupled together at an upper end to form the peak of the triangular truss. Each end of the lower chord member 54 is coupled to the lower end of one of the upper chord members 62. The upper chord members have the cross-section of FIGS. 1 or 2 and are positioned with the legs 14 extending downward to receive the upper ends of the interconnecting web members 56 inserted therebetween for attachment thereto.

The roof truss 60 may be formed from D chord members wherein the upper chord members 62 have the cross-section of the chord member of FIG. 1 or 2, or the lower chord member 54 has the cross-section of the chord member of FIG. 1 or 2, or both the upper and lower chord members 62,54 have the cross-section of the chord member of FIG. 1 or 2.

Figure 6:
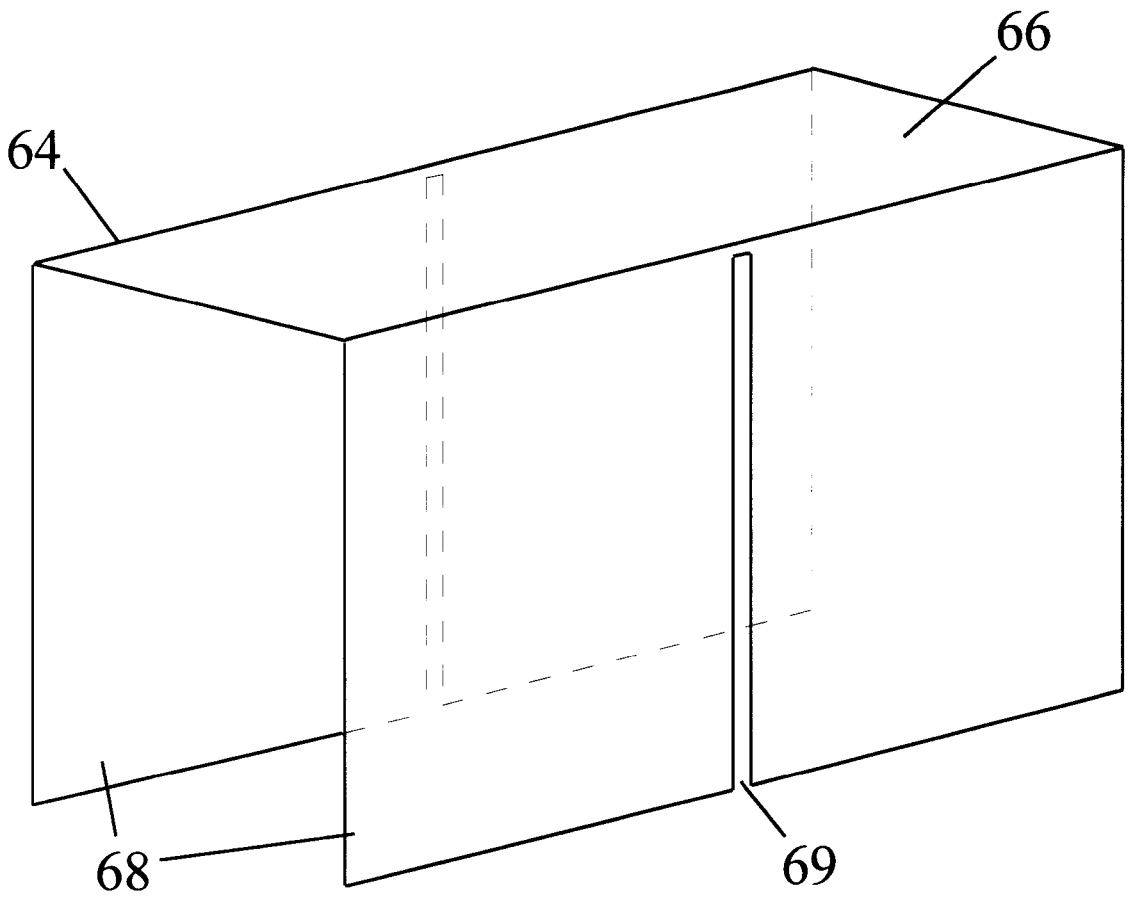
FIG. 6 is a pictorial view of the peak connection member.

The roof truss 60 may include a pitch break connection member 64. With reference to FIG. 6, pitch break connection member 64 is an elongated member comprising in cross-section a base 66 and two substantially parallel legs 68 extending in the same direction from the longitudinal edges of said base at a substantially right angle thereto. Each of the legs 68 have a cut 69 near the longitudinal middle of the legs 68 so that one half of a leg 68 may be partially folded over the other half of the leg 68 to form an angled base. Pitch break connection member 64 is then adapted to fit over and couple the upper chord members 62 at the pitch break of roof truss 60. In this embodiment, the pitch break of the roof truss is at a peak, however, pitch break connection member 64 may be used to couple truss chord members at any pitch break in the truss.

Figure 7A:
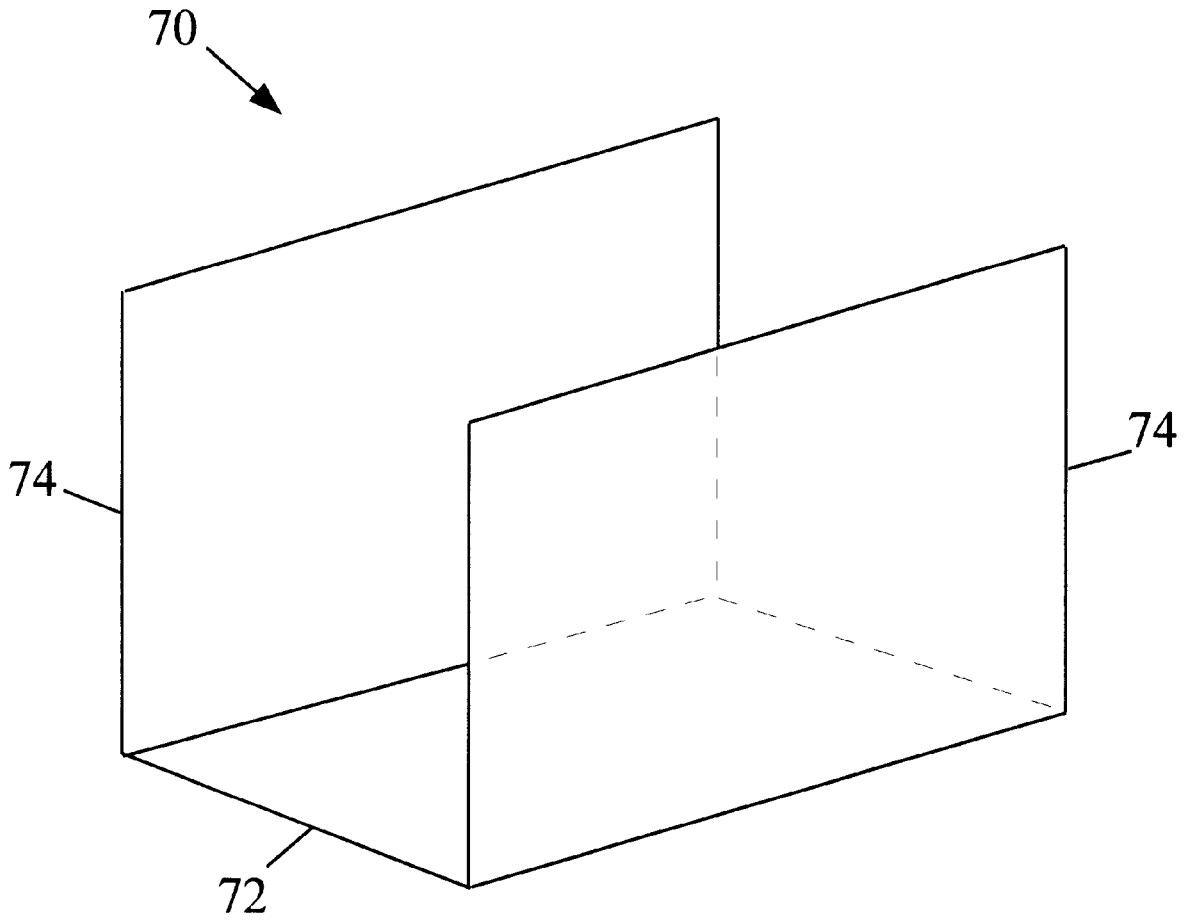
FIG. 7*a* is a pictorial view of the anchor member of the two piece truss anchor.

One embodiment of the two piece truss anchor is shown in FIG. 7. With reference to FIG. 7a, the anchor member 70 is an elongated member comprising in cross-section a base 72 and two substantially parallel legs 74 extending in the same direction from the longitudinal edges of base 72 at a substantially right angle thereto. Anchor member 70 is adapted to be positioned on the upwardly facing surface of a wall, such as the upper track member of metal framed wall, with the length of the anchor member 70 substantially perpendicular to the length of the wall. The width of the anchor member 70 is less than the width of the upwardly facing surface of the wall with the legs 74 extending upwardly to receive the lower chord member of a truss therebetween. The legs 74 may be attached to the truss chord member by any conventional means.

Figure 7B:
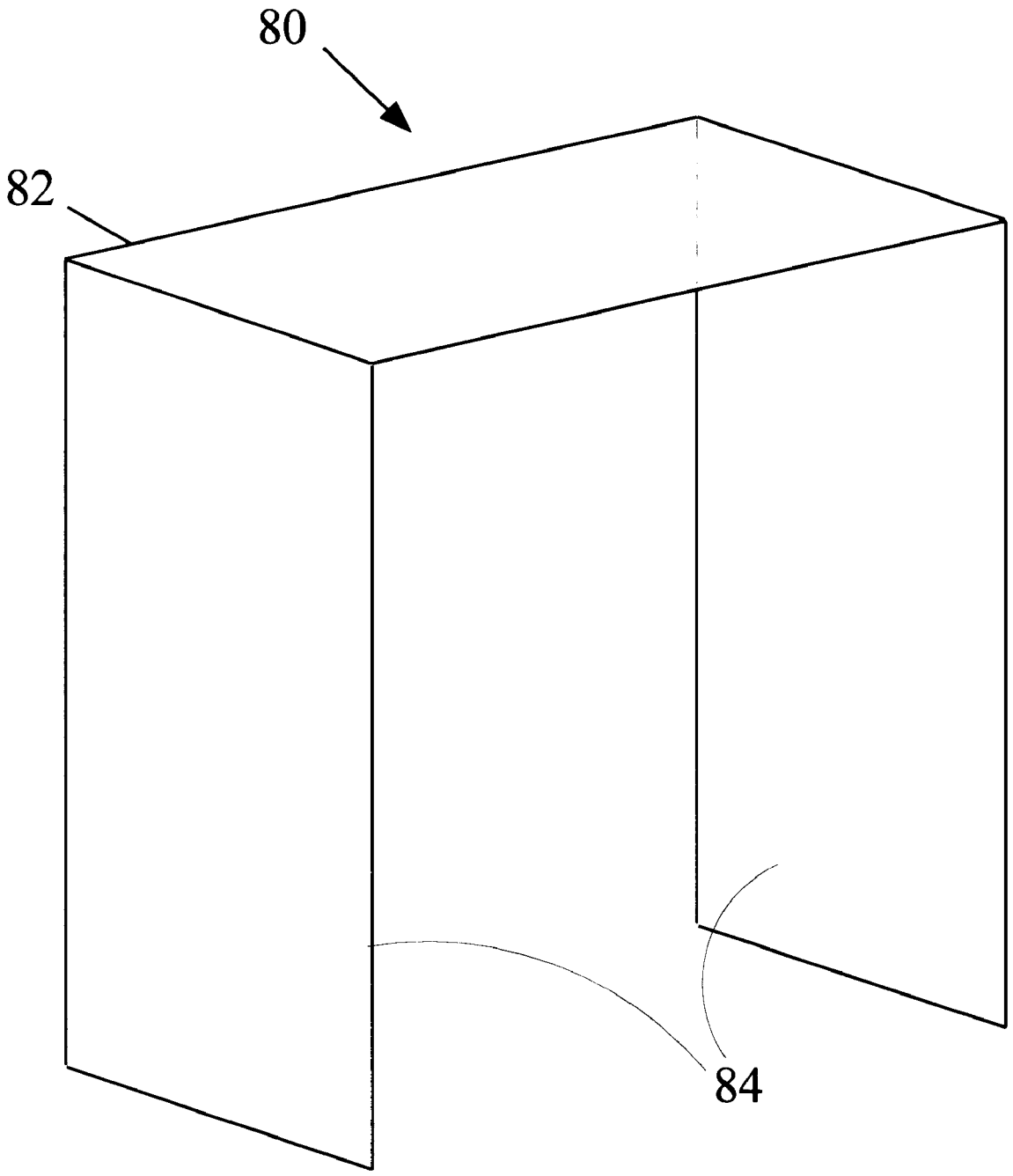
FIG. 7*b* is a pictorial view of the holddown strap of the two piece truss anchor.

With reference to FIG. 7*b*, the holddown strap 80 is an elongated member comprising in cross-section a base 82 and two substantially parallel legs 84 extending in the same direction from the longitudinal edges of base 80 at a substantially right angle thereto.

In the preferred embodiment, base 82 has a length slightly smaller than the width of the base 72 of the anchor member 70 and a width slightly larger than the width of the upwardly facing surface of the wall. This allows holddown strap 80 to be positioned transverse to anchor member 70 with base 82 between legs 74 and overlying base 72 of anchor member 70. The dimensional relationship between base 82 arid base 72 allows minor adjustments to be made when positioning a truss to anchor it atop a wall.

The width of base 82 may vary so that holddown strap 80 can fit a wall of any thickness. Legs 84 of holddown strap 80 extend downward adjacent the sides of the wall for attachment to a stud of the wall. The length of the legs 84 may vary to accommodate the desired number of attachments to the stud of the wall. Holddown strap 80 attaches the anchor member 70 to the stud of the wall so that when a truss is attached to the anchor member 70 the anchoring system provides a secure attachment of the truss to the wall which can withstand lifting forces, such as wind, exerted on the truss. Holddown strap 80 may be attached to the wall studs by any conventional means.

In the preferred embodiment, anchor member 70 and holddown strap 80 are roll formed from any suitable material such as 22 gauge, 20 gauge, 18 gauge, 16 gauge, or 14 gauge galvanized steel. The two piece anchor may also be produced by other cold forming methods such as stamping.

The two piece truss anchor provides the economic benefits of reducing waste by roll formed production utilizing the advantages of high speed production and automation. A single size anchor member may be mass produced and kept in inventory with holddown straps of various sizes to accommodate various size walls.

Figure 8:
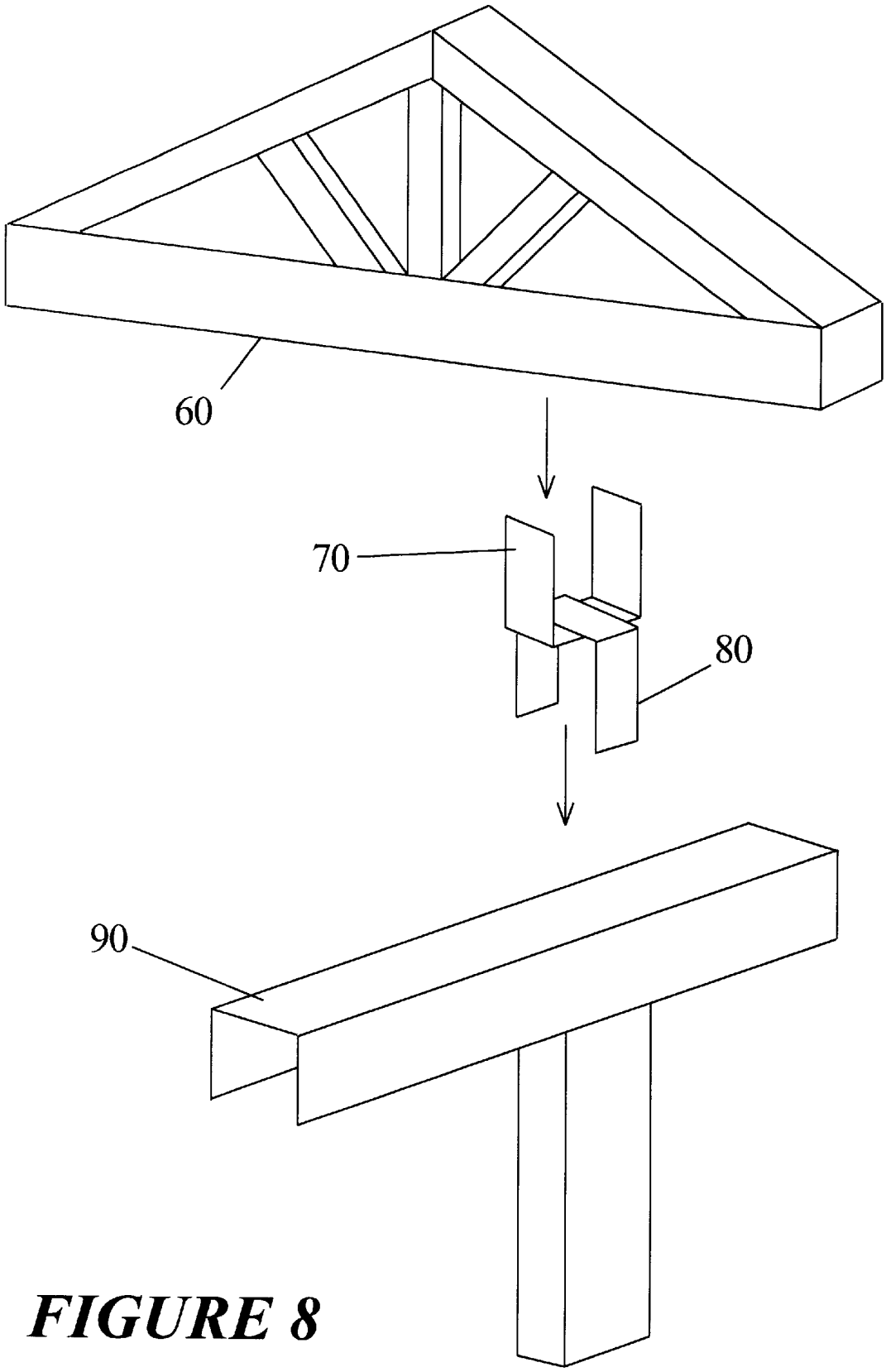
FIG. 8 is a pictorial view of the truss anchoring system.
Figure 9:
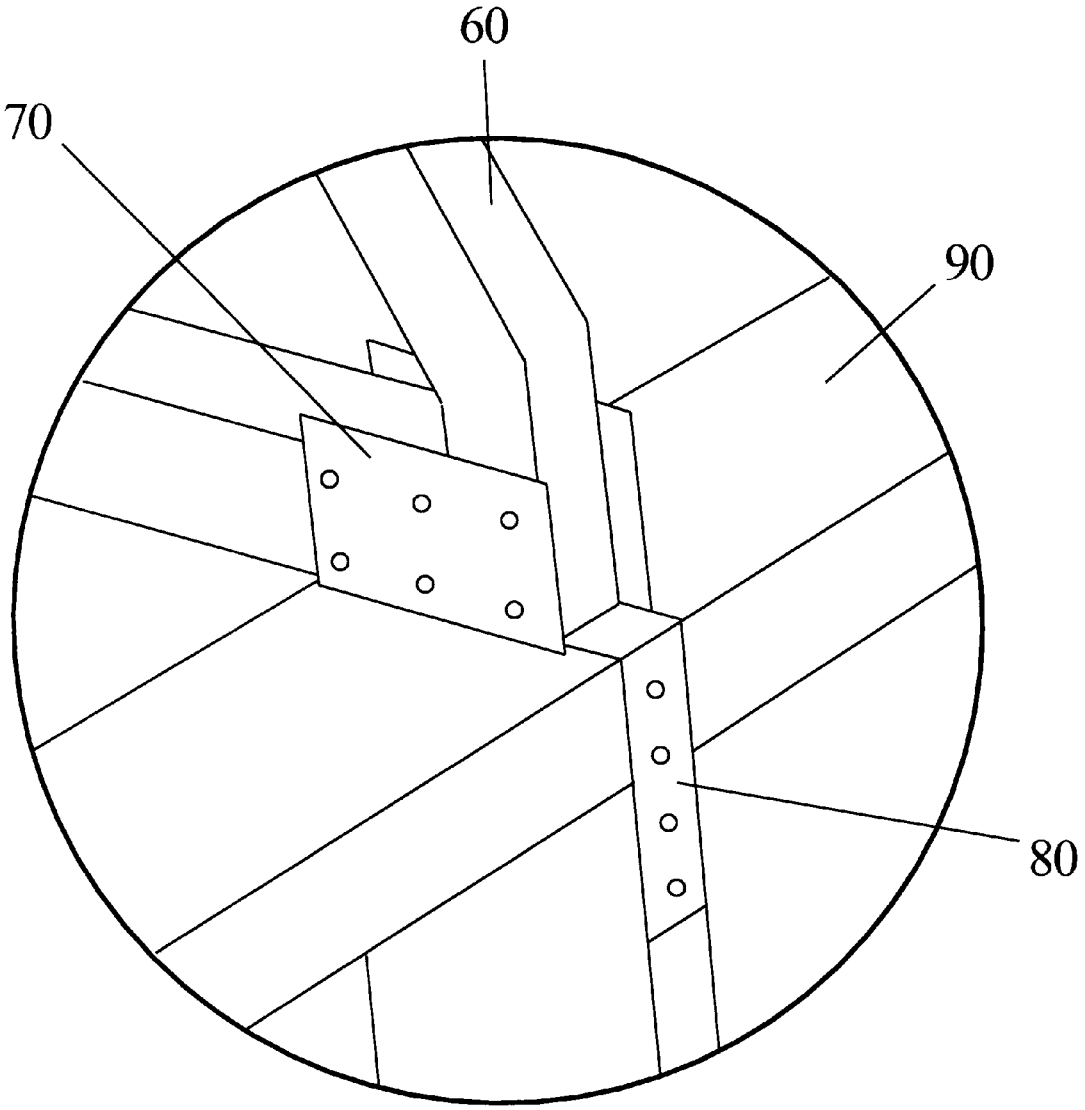
FIG. 9 is a pictorial view of a truss anchored to a wall.

FIGS. 8 and 9 show the truss anchoring system. In the construction of a building, the two piece truss anchor is attached to a wall in position for attachment to a truss by positioning anchor member 70 on upwardly facing surface 90, positioning holddown strap 80 between the legs and overlying the base of anchor member 70, and attaching the legs of holddown strap 80 to the wall. The two piece anchors may be attached to the wall either on or off the construction site.

A truss, such as roof truss 60 as shown, may then be positioned between the legs of anchor member 70 for attachment thereto.

While preferred embodiments of the present invention have been described, it is to be understood that the embodiments described are illustrative only and the scope of the invention is to be defined solely by the appended claims when accorded a full range of equivalence, many variations and Modifications naturally occurring to those of skill in the art from a perusal hereof.

What is claimed is:

1. A truss system comprising:

(a) a wall having a generally planar upwardly facing surface;

(b) a plurality of trusses, each truss comprising:
an elongated upper chord member;
an elongated lower chord member; and
a plurality of interconnecting web members, (c) said upper or lower chord member being a single-piece roll-formed member having a generally U-shaped cross-section, said cross section comprising:
a base; and
two substantially parallel legs extending in the same direction from the longitudinal edges of said base at a substantially right angle thereto, (d) each of said legs comprising:
a first outer face adjacent said base,
a second outer face adjacent the distal end of said leg, said second cuter face being coplanar with said first outer face,
an inwardly recessed face connecting said first and second outer faces, and
an inwardly turned hem extending from said second outer face, said hem having an inner face coplanar with said inwardly recessed face;

(e) a plurality of truss anchors located at spaced intervals along the length of said upwardly facing surface for transversely attaching a truss to a wall comprising:
an elongated anchor member comprising in cross-section a base and two substantially parallel legs extending in the same direction from the longitudinal edges of said ease at a substantially right angle thereto, said anchor member being positioned on the upwardly facing surface of a wall with the length of the anchor member being substantially perpendicular to the length of the wall and less than the width of the upwardly facing surface of the wall with said legs extending upwardly to attachably receive a truss between said legs and transverse to said wall; and an elongated holddown strap comprising in cross-section a base and two substantially- parallel legs extending in the same direction from the longitudinal edges of said base at a substantially right angle thereto, said holddown strap being positioned transverse to said anchor member with said base adjacent the base of said anchor member and between the legs of said anchor member with the legs of said holddown strap extending downwardly adjacent the sides of the wall for attachment to the wall;

whereby said holddown strap may attach said anchor member to the wall and said anchor member may be attached to a truss between said legs and transverse to the wall.

2. A truss system comprising:

(a) a wall having a generally planar upwardly facing surface;

(b) a plurality of trusses, each truss comprising:

an elongated upper chord member;

an elongated lower chord member; and a plurality of interconnecting web members, (c) each of said web members being a single-piece roll-formed elongated structural web member comprising in cross-section:

two substantially parallel sides and a central web substantially perpendicular to said sides, each of said sides comprising at one end an inward reverse fold overlying less than one-half the length of said side, each of said sides having at the other end an inward reverse fold overlying less than one-half the length of said side;

(d) a plurality of truss anchors located at spaced intervals along the length of said upwardly facing surface for transversely attaching a truss to a wall comprising:

an elongated anchor member comprising in cross-section a base and two substantially parallel legs extending in the same direction from the longitudinal edges of said base at a substantially right angle thereto, said anchor member being positioned on the upwardly facing surface of a wall with the length of the anchor member being substantially perpendicular to the length of the wall and less than the width of the upwardly facing surface of the wall with said legs extending upwardly to attachably receive a truss between said legs and transverse to said wall; and an elongated holddown strap comprising in cross-section a base and two substantially parallel legs extending in the same direction from the longitudinal edges of said base at a substantially right angle thereto, said holddown strap being positioned transverse to said anchor member with said base adjacent the base of said anchor member and between the legs of said anchor member with the legs of said holddown strap extending downwardly adjacent the sides of the wall for attachment to the wall;

whereby said holddown strap may attach said anchor member to the wall and said anchor member may be attached to a truss between said legs and transverse to the wall.

3. A wall adapted for attachment to a plurality of transverse trusses along the length thereof, said wall comprising:

a generally planar upwardly facing surface;

a plurality of truss anchors located at spaced intervals along the length of said upwardly facing surface, each of said anchors being a two piece anchor for transversely attaching a truss to a wall comprising:

an elongated anchor member comprising in cross-section:

a base and two substantially parallel legs extending in the same direction from the longitudinal edges of said base at a substantially right angle thereto, said anchor member being positioned on the upwardly facing surface of a wall with the length of the anchor member being substantially perpendicular to the length of the wall and less than the width of the upwardly facing surface of the wall with said leas extending upwardly to attachably receive a truss between said legs and transverse to said wall; and an elongated holddown strap comprising in cross-section:

a base and two substantially parallel legs extending in the same direction from the longitudinal edges of said base at a substantially right angle thereto, said holddown strap being positioned transverse to said anchor member with said base adjacent the base of said anchor member and between the legs of said anchor member with the legs of said holddown strap extending downwardly adjacent the sides of the wall for attachment to the wall.

4. A single-piece roll-formed elongated structural chord member having a generally U-shaped cross-section, said cross-section comprising:

a base; and two substantially parallel legs extending in the same direction from the longitudinal edges of said base at a substantially right angle thereto, each of said legs comprising:

a first outer face adjacent said base, a second outer face adjacent the distal end of said leg, said second outer face being coplanar with said first outer face, an inwardly recessed face connecting said first and second outer faces, and an inwardly turned hem extending from said second outer face, said hem having an inner face coplanar with said inwardly recessed face.

5. The structural chord member of claim 4 further comprising a longitudinal recessed groove in said base.

6. The structural chord member of claim 4 wherein said inwardly recessed face is recessed inward from said outer faces a minimum distance equal to two thicknesses of the chord member material.

7. The structural chord member of claim 4 wherein the length of said outer faces is approximately ½ inch.

8. The structural chord member of claim 4 wherein said inwardly recessed face is adapted for attachment to a structural member positioned between said legs.

9. The structural chord member of claim 4 wherein said legs further comprise a third outer face between said first outer face and said inwardly recessed face, said third outer face being coplanar with said first and second outer faces.

10. The structural chord member of claim 4 further comprising an inwardly angled portion interconnecting said first outer face with said inwardly recessed face.

11. The structural chord member of claim 4 further comprising an outwardly angled portion interconnecting said inwardly recessed face with said second outer face.

12. The structural chord member of claim 4 comprised of metal.

13. The structural chord member of claim 12 comprised of steel.

14. The structural chord member of claim 13 comprised of galvanized steel.

15. A single-piece roll-formed elongated structural chord member having a generally U-shaped cross-section, said cross-section comprising:

a base; and two substantially parallel legs extending in the same direction from the longitudinal edges of said base at a substantially right angle thereto, each of said legs comprising a web attachment face and a reinforcement rib adjacent the distal end of said legs, each of said reinforcement ribs comprising an outer face and an inwardly turned hem extending from said outer face, said hem having an inner face extending toward said base parallel to said web attachment face but not extending inward of the plane of said web attachment face.

16. The structural chord member of claim 15 wherein said inner face is substantially parallel to said outer face.

17. The structural chord member of claim 15 wherein said web attachment face and said inner face are coplanar.

18. The structural chord member of claim 15 wherein said reinforcement ribs further comprise an interconnecting portion normal to said outer face and interconnecting said outer face to said inner face.

19. A single-piece roll-formed elongated structural web member comprising in cross-section:

two substantially parallel sides and a central web substantially perpendicular to said sides, each of said sides comprising at one end an inward reverse fold overlying less than one-half the length of said side, each of said sides having at the other end a second inward reverse fold overlying a portion of the length of said side.

20. The structural web member of claim 19 wherein said second inward reverse folds overlie less than one-half the length of said sides.

21. The structural web member of claim 19 comprised of metal.

22. The structural web member of claim 21 comprised of steel.

23. The structural web member of claim 22 comprised of galvanized steel.

24. A truss comprising:

a first elongated upper chord member;

an elongated lower chord member; and a plurality of interconnecting web members, said upper or lower chord member being a single-piece roll-formed member having a generally U-shaped cross-section, said cross-section comprising:

a base; and two substantially parallel legs extending in the same direction from the longitudinal edges of said base at a substantially right angle thereto, each of said legs comprising:

a first outer face adjacent said base, a second outer face adjacent the distal end of said leg, said second outer face being coplanar with said first outer face, an inwardly recessed face connecting said first and second outer faces, and an inwardly turned hem extending from said second outer face, said hem having an inner face coplanar with said inwardly recessed face.

25. The truss of claim 24 wherein the outside dimension of the web members is approximately equal to the inside dimension of the upper and lower chord members.

26. The truss of claim 24 wherein said web members comprise in cross-section:

two substantially parallel sides and a central web substantially perpendicular to said sides, each of said sides comprising at one end an inward reverse fold overlying less than one-half the length of said side, each of said sides having at the other end a second inward reverse fold overlying a portion of the length of said side.

27. The truss of claim 4 further comprising a second upper chord member, said upper chord members being coupled together at an upper end forming the peak of a roof truss, and each end of said lower chord member being coupled to a lower end of one of said first and second upper chord members.

28. The truss of claim 27 further comprising a pitch break connection member, said pitch break connection member being an elongated structural member comprising in cross-section:

a base, said base being slightly wider than the base of the first and second upper chord members; and two substantially parallel legs extending in the same direction from the longitudinal edges of said base at a substantially right angle thereto, said legs being cut at the longitudinal middle and folded to form an angled base so that said pitch break connection member is adapted to fit over and couple said first and second upper chord members at said upper ends.

29. A truss comprising:

a first elongated upper chord member;

an elongated lower chord member; and a plurality of interconnecting web members, each of said web members being a single-piece roll-formed elongated structural web member comprising in cross-section:

two substantially parallel sides and a central web substantially perpendicular to said sides, each of said sides comprising it one end an inward reverse fold overlying less than one-half the length of said side, each of said sides having at the other end an inward reverse fold overlying less than one-half the length of said side.

30. The truss of claim 29 wherein said upper or lower chord member is a single-piece roll-formed member having a generally U-shaped cross-section, said cross-section comprising:

a base; and two substantially parallel legs extending in the same direction from the longitudinal edges of said base at a substantially right angle thereto, each of said legs comprising:

a first outer face adjacent said base, a second outer face adjacent the distal end of said leg, said second outer face being coplanar with said first outer face, an inwardly recessed face connecting said first and second outer faces, and an inwardly turned hem extending from said second cuter face, said hem having an inner face coplanar with said inwardly recessed face.

31. The truss of claim 29 further comprising a second upper chord member, said upper chord members being coupled together at an upper end forming the peak of a roof truss, and each end of said lower chord member being coupled to a lower end of one of said first and second upper chord members.

32. The truss of claim 31 further comprising a pitch break connection member, said pitch break connection member being an elongated structural member comprising in cross-section:

a base, said base being slightly wider than the base of the first and second upper chord members; and two substantially parallel legs extending in the same direction from the longitudinal edges of said base at a substantially right angle thereto, said legs being cut at the longitudinal middle and folded to form an angled base so that said pitch break connection member is adapted to fit over and couple said first and second upper chord members at said upper ends.

33. A two piece anchor for transversely attaching a truss to a wall comprising:

an elongated anchor member comprising in cross-section a base and two substantially parallel legs extending in the same direction from the longitudinal edges of said base at a substantially right angle thereto, said anchor member being adapted to be positioned on the upwardly facing surface of a wall with the length of the anchor member being substantially perpendicular to the length of the wall and less than the width of the upwardly facing surface of the wall with said legs extending upwardly to attachably receive a truss between said legs and transverse to said wall; and an elongated holddown strap comprising in cross-section a base and two substantially parallel legs extending in the same direction from the longitudinal edges of said base at a substantially right angle thereto, said holddown strap being adapted to be positioned transverse to said anchor member with said base adjacent the base of said anchor member and between the legs of said anchor member, the legs of said holddown strap being adapted to extend downwardly adjacent the sides of the wall for attachment to the wall;

said holddown strap being positioned so that the legs thereof and the legs of said anchor member extend in substantially opposite directions;

whereby said holddown strap may attach said anchor member to the wall and said anchor member may be attached to a truss between said legs and transverse to the wall.

34. The anchor of claim 33 comprised of metal.

35. The anchor of claim 34 comprised of steel.

36. The anchor of claim 34 comprised of galvanized steel.

37. The wall of claim 3 wherein the width of said base of said holddown strap is approximately equal to the width of said upwardly facing surface of the wall.

38. The wall of claim 3 wherein the length of said anchor member is slightly less than the width of the upwardly facing surface of the wall.

39. The wall of claim 3 wherein the legs of said holddown strap extend downwardly adjacent the sides of said wall for attachment to a stud of the wall.

40. A single-piece roll-formed elongated structural chord member having a generally U-shaped cross-section, said cross-section comprising:

a base; and two substantially parallel legs extending in the same direction from the longitudinal edges of said base at a substantially right angle thereto, at least one of said legs comprising:

a first outer face, a second outer face adjacent the distal end of said leg, said second outer face and being coplanar with said first outer face;

an inwardly recessed face connecting said first and second outer faces; and an inwardly turned reverse fold extending from the distal end of said second outer face, said fold having an inner face extending toward said base and being coplanar with said inwardly recessed face.

41. An elongated structural chord member having a generally U-shaped cross-section, said cross-section comprising:

a base; and two substantially parallel legs extending in the same direction from the longitudinal edges of said base at a substantially right angle thereto, each of said legs comprising:

a first outer face adjacent said base, a second outer face adjacent the distal end of said leg, an inwardly recessed face connecting said first and second outer faces, and a reinforcement flange extending from said second outer face, said flange having a lower face extending inwardly from said second outer face and an inner face extending from said lower face toward said base parallel to said inwardly recessed face, said inner face not extending inward beyond the plane of said recessed face.

42. An elongated structural chord member having a generally U-shaped cross-section, said cross-section comprising:

a base; and two substantially parallel legs extending in the same direction from the longitudinal edges of said base at a substantially right angle thereto, each of said legs comprising:

an outer face adjacent said base, an inwardly recessed face extending from said outer face and being substantially perpendicular to said base, and a flange forming the distal end of said leg, said flange comprising an outer flange face extending from said recessed face and an inwardly turned hem extending from said outer flange face, said hem having an inner face extending toward said base coplanar with or outside of the plane of said inwardly recessed face.

43. The structural chord member of claim 42 wherein said inwardly recessed face and said inner face are coplanar.

44. The structural chord member of claim 42 wherein said outer face and said outer flange face are coplanar.

45. The structural chord member of claim 41 wherein said inwardly recessed face and said inner face are coplanar.

46. The structural chord member of claim 41 wherein said first and second outer faces are coplanar.

47. The structural chord member of claim 10 wherein said inwardly angled portion extends away from said base.

48. The structural chord member of claim 11 wherein said outwardly angled portion extends away from said base.

* * * * *